United States Patent [19]

Throp

[11] 4,330,947

[45] May 25, 1982

[54] APPARATUS FOR AIDING WATER REMOVAL OF A PAPER WEB BY INDEPENDENTLY CONTROLLING THE STEAM FLOW IN A PLURALITY OF COMPARTMENTS

[75] Inventor: Benjamin A. Throp, Menands, N.Y.

[73] Assignee: Huyck Corporation, Wake Forest, N.C.

[21] Appl. No.: 200,683

[22] Filed: Oct. 27, 1980

[51] Int. Cl.[3] ..... F26B 21/12

[52] U.S. Cl. ..... 34/54; 34/155; 137/263; 137/883; 162/252; 162/290

[58] Field of Search ..... 162/207, 290, 359, 252, 162/253; 34/34, 216, 217, 54, 155; 239/551, 562, 564; 137/883, 263

[56] References Cited

U.S. PATENT DOCUMENTS

| | | | |
|---|---|---|---|
| Re. 28,968 | 9/1976 | Dove | 162/290 |
| 3,089,252 | 5/1963 | Daane et al. | 34/34 |
| 3,945,881 | 3/1976 | Speidel | 162/290 |
| 4,249,992 | 2/1981 | Wells | 162/207 |
| 4,268,976 | 5/1981 | Dove | 34/155 |

*Primary Examiner*—Marc S. Alvo
*Attorney, Agent, or Firm*—Kenway & Jenney

[57] ABSTRACT

An apparatus for aiding water removal from a moving paper web directs steam to a portion of the web and controls the distribution of steam in both the cross-machine and the machine direction of the web. In the preferred embodiment, a matrix of compartments is used to supply steam to the web, and the steam supply to each compartment is independently controlled.

1 Claim, 2 Drawing Figures

APPARATUS FOR AIDING WATER REMOVAL OF A PAPER WEB BY INDEPENDENTLY CONTROLLING THE STEAM FLOW IN A PLURALITY OF COMPARTMENTS

BACKGROUND OF INVENTION

This invention relates to paper-making apparatus and more particularly to apparatus for aiding water removal from a moving paper web by application of steam.

Certain paper grades demand uniform sheet properties across the width of the web (in the cross-machine direction). In other grades, such properties are valuable. If this uniformity is to be achieved when using steam to help remove water from a paper slurry or web, accurate control of the heat transfer is essential. Although some systems have used steam to increase water removal from the web and thereby improve the uniformity of the sheet properties, these systems offer only coarse control over the amount of steam applied to each portion of the web. They do not provide the desired degree of uniformity.

One reason for the prior art systems' inability to obtain better uniformity is their failure to recognize the importance of dwell time, i.e., the amount of time in which the steam is in contact with the paper. For most applications, dwell time governs the amount of heat that is transferred from the steam to the paper. The prior art systems do not control dwell time; they only supply or shut off steam to a section of the width of a web. Those sections of the paper that receive no steam do not receive the benefits of improved water removal.

In addition, the systems in the art profile the application of steam to the web only in the cross-machine direction. Thus, these systems can not vary the application of steam along the length of the web, i.e., in the machine direction. This limits the systems' control over water removal so that uniform sheet properties may be difficult to obtain.

SUMMARY OF INVENTION

This invention overcomes the limitations of the prior art systems by providing accurate control of dwell time. Instead of reducing steam from a section of the width of the web, this invention controls how long each section of the moving web is in contact with the steam by controlling both the machine direction and cross-machine direction steam application. Thus, the invention allows the entire paper web to receive the benefit of improved water removal afforded by the use of steam.

To achieve the objects of the invention, as embodied and as broadly described herein, the apparatus for aiding water removal from a moving paper web comprises a means for distributing steam to a portion of the length of the web and a means for controlling the distribution of steam to a matrix of adjoining regions extending both across and along the portion of the moving web, the control of the steam to each region being independent of the others.

More specifically, the invention comprises a matrix of independent, enclosed compartments arranged in a plurality of rows and in a plurality of columns across the portion of the moving web, support means for the compartments, steam supply means providing steam controlled independently to each compartment, and steam outlet means directing steam from each compartment to a portion of the moving web.

The invention also includes a method for aiding water removal from a moving paper web by distributing steam to a matrix of adjoining regions in a portion of the length moving web, the matrix of regions remaining stationary and covering different portions of the web as the web moves, and controlling the distribution of steam to each region independently of the application of steam to the other regions.

The accompanying drawings, which are incorporated in and constitute a part of this specification, illustrate one embodiment of the invention and, together with the description, explain the principles of the invention.

DESCRIPTION OF THE PREFERRED EMBODIMENT

Figure 1:
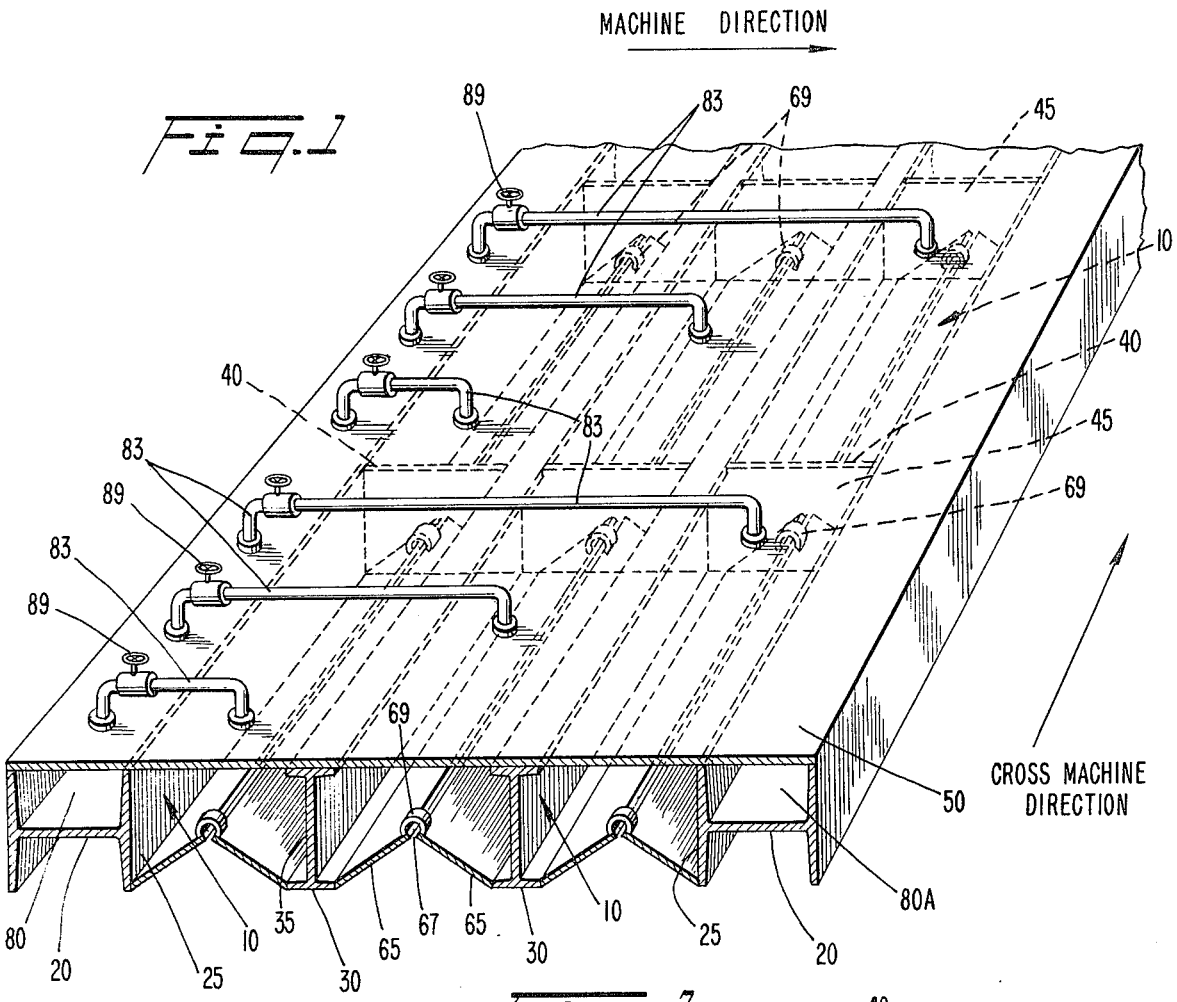
FIG. 1 is a perspective view at the matrix steam oven.
Figure 2:
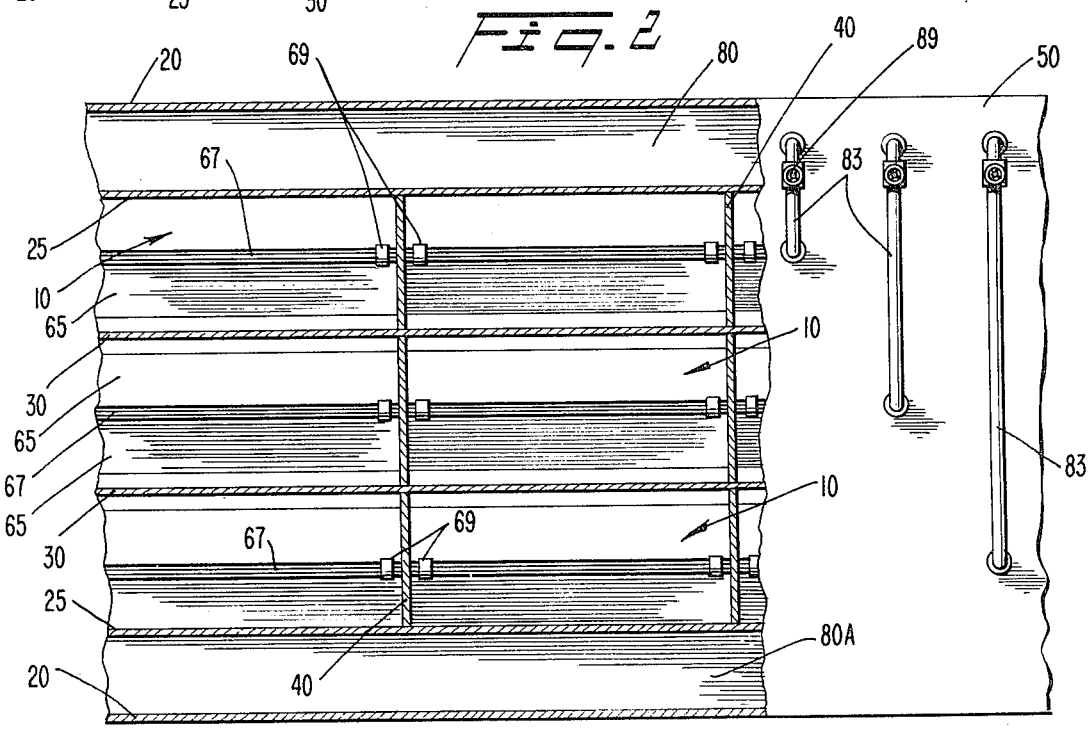
FIG. 2 is a partially cut away top view of the oven in FIG. 1.

The drawings and this description refer to the preferred embodiment of an apparatus for forming paper sheets, also known as a matrix steam oven, which uses steam to aid water removal from a moving paper web. The matrix steam oven 1 is oriented in FIG. 1 for use above a paper web moving in the machine direction. This oven directs steam down to the web to heat the retained water in the web and facilitate water removal. The oven may also be reoriented and used below the web, in which case the steam would be directed upward to the web.

In accordance with the invention, the apparatus contains means for controlling the distribution of steam to a matrix of adjoining regions extending both across and along a portion of the length of the moving web. As herein embodied, this means includes a matrix of independent, closed compartments 10. The compartments are constructed so steam cannot flow between them.

The compartments enable one to control dwell time and to profile steam in the machine direction. In the illustrated embodiment, each compartment sits above a region of the web and either supplies or withholds steam to that region. Each part of the web passes under a number of compartments (a machine direction column of compartments) and some of those compartments will supply steam to the web. The sheet properties of the paper at each part of the web depends on how many and which compartments have supplied steam to it.

In accordance with the invention, the oven includes support means for the compartments. In the embodiment illustrated, the support means also form part of the compartments' structure. This means includes two end structural members 20, which, as seen in the drawings, are I-beams turned sideways. The I-beams extend in the cross-machine direction along the entire length of the oven, which in this embodiment is approximately the same as the width of the paper web. The end I-beams from the outer walls 25 of those compartments in the outside, cross-machine direction rows of compartments.

The support means also includes intermediate structural members 30 placed between the end structural members. As herein embodied, those intermediate structural members are also I-beams extending the length of the oven. They are parallel to the end structural I-beams and they stand upright. These intermediate members also form the remainder of the cross-machine direction walls 35 of the compartments 10.

The support means further includes stiffeners for the oven which extend between the end structural members and are joined to the intermediate structural members. These stiffeners 40 are embodied herein as plates which lie perpendicular to the end member I-beams 20 and the intermediate member I-beams 30. The stiffeners also form the machine direction walls 45 of the compartments 10 and are joined to the I-beams so that no steam can escape between compartments through the stiffener and I-beam joints.

The oven has a cover means 50 secured to and spanning the end structural members, the intermediate structural members, and the stiffeners, and forming the side of the compartments farthest from the web. As herein embodied, the cover means is a cover support which forms the top of each compartment. If the steam oven were oriented underneath the moving paper web, the cover support would form the compartments' bottom. All the edges formed by the cover support are steam-tight.

Five sides of the compartments are thus formed by elements that also supply support for the oven. By using the support members as the structural elements of the compartments, this oven is made lighter and less expensive.

The remaining side of the compartment, the side nearest the paper web, is composed of an element which directs steam to the web.

The means for distributing steam to a portion of the web includes at least one steam outlet means from each compartment to a portion of the web. In this embodiment, the steam outlet means includes a baffle means forming the side of each compartment closest to the paper web. Two baffles 65 are arranged in the shape of a V, the vertex of which points away from the web. The baffles are separated by a gap 67. Steam is directed through this gap to the web. Spacers 69 are used to maintain the proper size gap between baffles 65. The purpose of this configuration is to distribute the steam evenly. As herein embodied, the baffles 65 form the sixth side of compartments 10. The details of this type of V-shaped baffle can be found in U.S. Pat. No. 28,968 which is herein incorporated by reference.

The means for distributing steam also includes steam supply means for providing a supply of steam controlled independently to each compartment. This includes a plurality of secondary conduit means connected to the primary steam conduits. As herein embodied, the secondary conduit means includes a plurality of pipes 83, each pipe being connected to one compartment. The pipes pass into the compartments through cover support 50. Each pipe has a valve 89 to control the flow of steam through the pipe and, ultimately, to control the flow of steam into a compartment and onto a region of the web.

The apparatus also includes a primary steam conduit means, herein embodied as two steam ducts 80 and 80A formed by the cover support and the upper troughs of the sideways I-beam end members. Only one steam duct 80 is used in the illustrated embodiment but both could be used in a different configuration.

The oven operates by applying steam to a matrix of adjoining regions of the moving web and by independently controlling the application of steam to each region. Steam enters the compartments from a primary steam duct 80 and through one of a plurality of pipes 83, providing the valve in that pipe is open.

By controlling the flow of steam into the individual compartments, steam is applied only to selected regions of the paper web at any one time. One using the oven can control the dwell time at each part of the web accurately by controlling the number of compartments that are supplied with steam. Also, the profile of the steam distributed to the web in both the machine and cross-machine directions is determined by which compartments are activated.

As mentioned earlier, the steam oven can be used on either side of paper web. It can also be used on both sides of the web, either simultaneously or consecutively. The particular configuration of the oven depends upon the space limitations and upon the proper use of the steam for the particular quality, weight, speed and temperature of the web. The oven can also be used directly on the web or in connection with a suction box or roll by methods known in the art.

It will be apparent to those skilled in the art that modifications and variations can be made in this oven without departing from the scope or the spirit of the invention. It is intended that the present invention cover those modifications and variations provided they come within the scope of the appended claims and their equivalents.

What is claimed is:

1. An apparatus for aiding water removal from a paper web comprising:

two parallel I-beams turned on their side and acting as end structural members;

a plurality of I-beams standing upright, placed parallel to and between the end structural members and serving as intermediate structural members;

a plurality of stiffeners perpendicular to and joined with the I-beams forming a matrix of compartments;

a cover support secured to and spanning the I-beams and the stiffeners and forming a side of the compartments farthest from the paper web;

V-shaped baffles forming a side of each compartment closest to the paper web, with the vertices of the baffles pointing away from the web;

a gap between the V-shaped baffles at the vertices of the V for permitting steam to exit the compartments to the web;

at least one primary steam duct formed by the cover support and the upper troughs of the sideways I-beam end members;

a plurality of pipes with each of said compartments being connected by at least one of said pipes to said at least one primary steam duct; and a plurality of valves, each valve controlling the flow of steam through one of the plurality pipes thereby independently controlling the steam flow to each compartment.

* * * * *